US007647919B2

(12) United States Patent
Moller et al.

(10) Patent No.: US 7,647,919 B2
(45) Date of Patent: Jan. 19, 2010

(54) DIRECT FUEL INJECTION CONTROL WITH VARIABLE INJECTOR CURRENT PROFILE

(75) Inventors: David D. Moller, Westfield, IN (US); Gordon D. Cheever, Jr., Peru, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/152,303

(22) Filed: May 14, 2008

(65) Prior Publication Data

US 2009/0287393 A1 Nov. 19, 2009

(51) Int. Cl.
*F02M 51/00* (2006.01)
*F02M 37/04* (2006.01)

(52) U.S. Cl. ..... 123/478; 123/480; 123/490

(58) Field of Classification Search ..... 123/445, 123/478, 480, 490; 361/152, 153, 154
See application file for complete search history.

(56) References Cited

U.S. PATENT DOCUMENTS

| | | | | |
|---|---|---|---|---|
| 4,312,038 | A * | 1/1982 | Imai et al. | 701/115 |
| RE32,163 | E * | 5/1986 | Tokuda et al. | 701/114 |
| 5,408,975 | A * | 4/1995 | Blakeslee et al. | 123/491 |
| 5,701,870 | A | 12/1997 | Gottshall et al. | |
| 6,236,554 | B1 | 5/2001 | Groppo et al. | |
| 6,999,869 | B1 * | 2/2006 | Gitlin et al. | 701/115 |
| 2003/0041593 | A1 * | 3/2003 | Yoshida et al. | 60/285 |
| 2004/0045536 | A1 * | 3/2004 | Hafner et al. | 123/480 |

FOREIGN PATENT DOCUMENTS

| | | |
|---|---|---|
| DE | 3515040 | 7/1986 |
| EP | 0924589 | 6/1999 |
| EP | 1847705 | 10/2007 |
| WO | WO 20081116748 | 10/2008 |

OTHER PUBLICATIONS

European Search Report dated September 11, 2009.

* cited by examiner

*Primary Examiner*—John T Kwon
(74) *Attorney, Agent, or Firm*—Jimmy L. Funke

(57) ABSTRACT

A direct fuel injection control for an internal combustion engine includes first and second controllers. The first controller has a microprocessor and generates injection timing and duration signals on injector select lines. The second controller is a state machine including injector controls that receive the injection timing and duration signals and control injector current according to sets of injector current profile defining parameters received from the first controller on a serial bus and stored in register sets in the second controller. The second controller includes switching apparatus that can quickly change the connection of each injector control between different register sets to select different injector current profiles in successive injection pulses. Several alternative ways of providing register select signals are disclosed, and these may be incorporated in the same second controller for selection by the first controller.

21 Claims, 8 Drawing Sheets

DIRECT FUEL INJECTION CONTROL WITH VARIABLE INJECTOR CURRENT PROFILE

TECHNICAL FIELD

The technical field of this invention is direct fuel injection controls for internal combustion engines.

BACKGROUND OF THE INVENTION

In internal combustion engines utilizing solenoid activated fuel injectors for direct injection into combustion chambers, physical characteristics of the injector solenoid coil are often generally compensated by varying the injector current over the duration of a fuel pulse according to a predetermined injector current profile. One such physical characteristic is the inductive nature of the injector solenoid coil; and a typical such profile may provide an initial rise to a peak current level, in order to open the injector valve as rapidly as possible, followed by one or more periods of maintenance current at lower current levels. Some prior art direct fuel injection systems use a customized injector pulse profile for each injector in order to compensate for the injectors' physical variations from each other.

But the use of different injector current profiles can also be used to optimize fuel pulses to produce different combustion characteristics, particularly in the delivery of multiple consecutive fuel pulses per combustion event in gasoline fueled, direct injected engines. In such multi-pulse delivery, variation of the injector current profiles—and thus the fuel pulse profiles—of consecutive fuel pulses in a single combustion chamber can provide a more precise desired control of the overall fuel delivery to meet more stringent emission and fuel economy goals. Such multi-pulse fuel delivery may be used to produce rapid catalyst light-off or to provide a lean homogeneous fuel mixture.

Fuel injector current profile control directly by a microprocessor in a direct injected engine fuel control system is impractical due to the limited number of available microprocessor output pins, microprocessor throughput constraints, and the inherent communication bandwidth limitations of serial bus communications; and this is especially true for modes of operation in which multi-pulse delivery per combustion event is provided. Thus, fuel injection controls for direct injected, internal combustion engines more typically provide a microprocessor that determines the selected injector, pulse timing, and pulse duration of each injected fuel pulse through dedicated output pins while separate injector current control circuits control the current profiles of the fuel pulses according to internally stored injector current profile defining parameters. Sets of these parameters, with each set tailored for one or more specific injectors, may be programmed into the memory of the microprocessor upon injector installation in the engine and loaded into injector-dedicated registers in the injector control circuits upon each initiation of engine operation. Alternatively, they may be installed directly into registers in the injector current control circuits.

These controls operate reliably for operation as they are designed: wherein a single fuel pulse or multiple fuel pulses are delivered in each combustion event, and the injector current profile of each injector, though potentially different from the others, is unchanging during engine operation. But the provision of different injector current profiles in consecutive multiple fuel pulses in each combustion event requires a much higher communication bandwidth between the microprocessor of the engine fuel control and the injector current control circuits than these controls can reliably provide using affordable current technology.

SUMMARY OF THE INVENTION

The fuel injection system of this invention enables direct fuel injection into the combustion chambers of an internal combustion engine in multiple successive injection pulses with different injector current profiles for a single injector in each combustion event. The system provides two controllers, in which the first controller uses a microprocessor to determine the injector, timing, and duration for each injection pulse and the second controller is a state machine controlling the current in each injection pulse according to a set of injector current profile defining parameters. A plurality of such parameter sets are stored in memory in the first controller and are communicated to register sets of the second controller via a serial communication bus. The microprocessor of the first controller also generates injection pulse signals indicating the timing and duration of each fuel injection pulse and provides them on the appropriate injector select lines. Within the second controller, injector control circuits receive the injection pulse signals from the first controller on the injector select lines and are selectively connectable to any one of the register sets at a time, to use whichever set of injector current profile defining parameters are stored therein. The second controller further includes switching apparatus for determining the register set to which each injector control circuit is connected for any injection pulse responsive to register select signals. In some embodiments, the switching apparatus may be placed alternatively in a plurality of different switching configurations by the first controller via the serial communication bus, wherein they are responsive to various register select signals to determine the connections between injector control circuits and register sets. Examples of register select signals include (a) the injection pulse signals on the injector select lines, (b) dedicated register signals on register select lines, or (c) pointers stored in a pointer register and selected in a predetermined order by the injection pulse signals on the injector select lines.

The system thus uses the first controller for overall system organization, fuel requirement determination, long term storage of the sets of injector current profile defining parameters, and generation of fuel pulse timing and duration signals; and the system uses the second controller for real-time injector control and current management using the injector current profile defining parameters stored in the register sets. The ability of the second controller to quickly switch the connection of each injector control circuit between register sets preloaded with different sets of injector current profile defining parameters enables any of the injectors to provide different current profiles in successive injection pulses during a single combustion event.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
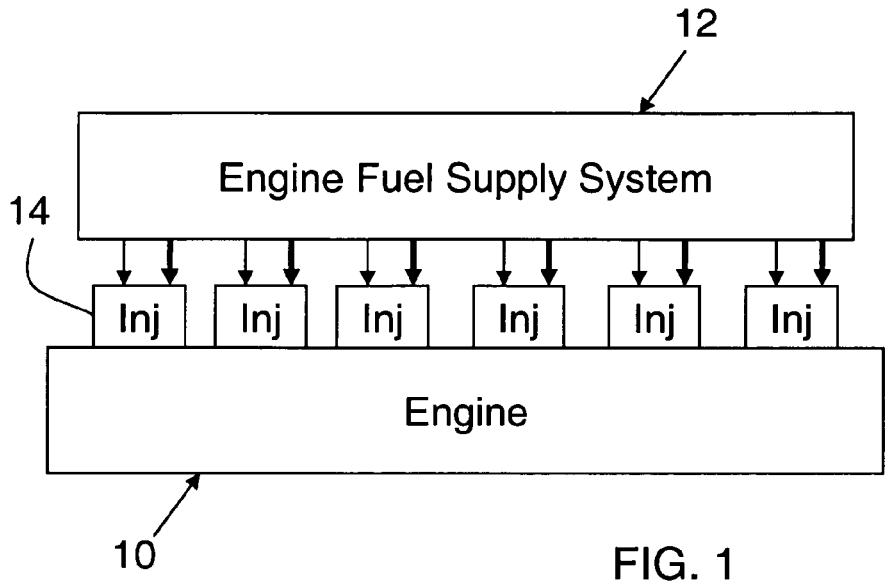
FIG. 1 shows a block diagram of an engine having an engine fuel supply system providing direct injection of fuel via fuel injectors.

Referring to FIG. 1, an engine 10 has a plurality of combustion chambers, not shown, the plurality being six in this embodiment. Each of the combustion chambers is provided with a fuel injector 14 for delivery of fuel by injection directly into the combustion chamber from an engine fuel supply system 12. A pair of arrows is shown between engine supply 12 and engine 10. The broader arrow on the right of each pair represents the fuel conduit from engine fuel supply system 12 to the injector, while the narrower arrow on the left of each pair represents an electrical signal conduit for injector activation control. The specifics of the embodiment shown, such as number of injectors, conduits or signal lines is for example only and are not meant to limit the scope of the invention.

Figure 2:
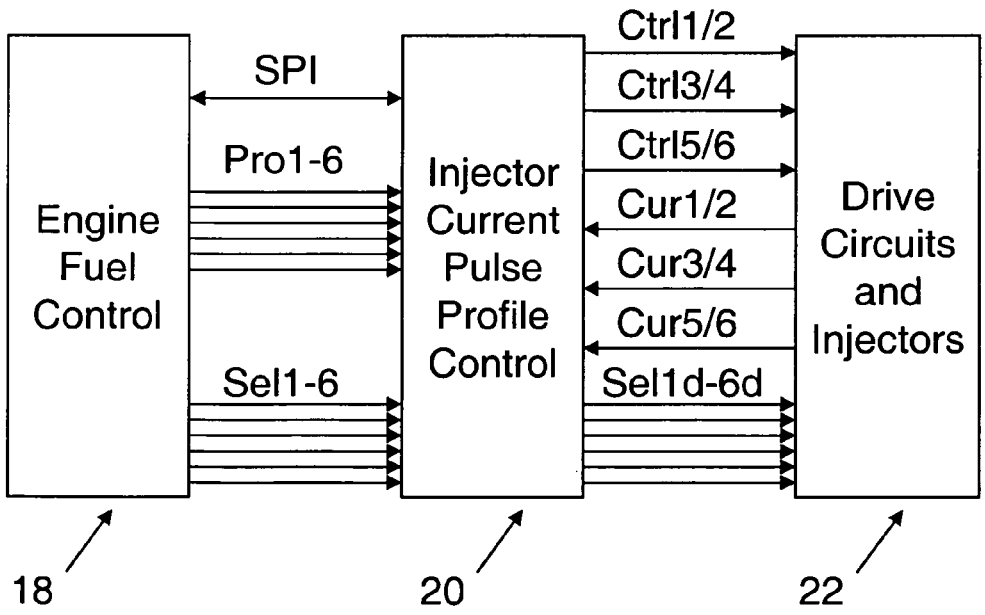
FIG. 2 shows a block diagram of a portion of the engine fuel supply system of FIG. 1 including a fuel injection control according to this invention.

The portion of engine fuel supply system 12 required for a description of an embodiment of this invention is shown in FIG. 2. An engine fuel control 18 provides signals to an injector current pulse profile control 20, which in turn provides signals to the injector drive circuits and injectors block 22 (the latter including injectors 14 of FIG. 1). Each of these devices 18, 20 and 22 are briefly described in the following paragraphs.

Engine fuel control 18 is similar to such controls in standard use, except as described herein. It is preferably based on at least one digital microprocessor programmed to determine the fuel needs of the engine through appropriate sensors for determining engine operating parameters such as crankshaft position, engine speed, engine load (intake airflow or throttle vacuum), etc., and to further determine and signal the timing and duration of injector activation in specified combustion chambers in the normal course of engine operation.

Engine fuel control 18 includes a non-volatile memory dedicated for storage of a plurality of sets of injection current profile parameters. Each of these sets comprises numerical values defining such parameters as maximum and minimum switching current levels and time durations for injector current to produce a predetermined injector current profile during a single injector pulse. These sets of injection current profile parameters may be programmed into the memory of engine fuel control 18 at any time when the engine is not operating. Once programmed into the memory, any of these stored sets of injection current profile parameters are available for use by injector current pulse profile control 20 as supplied and directed by the microprocessor.

Although engine fuel control 18 will have many lines for communication with other devices, the following lines are shown as used in the practice of this invention. A communication bus, preferably a serial peripheral interface (SPI), connects the microprocessor of engine fuel control 18 with other devices for communication of various messages and or data transfers. This bus is generally not used for real time activation of peripheral devices such as fuel injectors 14.

A set of injector select lines Sel1-6 provides a separate digital injector selection and activation line (Sel1, Sel2, etc.) for each of injectors 14 in engine 10. Each of lines Sel1-6 conveys an injection pulse signal on an output pin of the microprocessor comprising one of two digital levels, in which one of the levels (for example, "0") means that the identified injector is not selected and the other of the levels (for example, "1") means that the identified injector is selected. The microprocessor of engine fuel control 18 is configured to provide a selection of the injector to be activated by the selection of the individual line (Sel1, Sel2, etc.) and timing control for activation and deactivation of the selected injector by level switching, in order to provide real-time control of fuel pulse timing and duration. It should be noted that the word "duration" used in the previous sentence means the total duration of a single injection pulse, regardless of whether or not any switching for injector current control is being used by an injector control circuit during the injection pulse.

A set of register select lines Pro1-6 are provided from output pins of the microprocessor of engine fuel control 18 for identification of particular ones of a plurality of register sets (to be described below) in injector current pulse profile control 20. Each of these lines also carries a signal comprising one of two digital levels ("0" or "1"). Their use is somewhat more complex, and its further description is deferred to a point in this description in which it can be described in context.

Figure 3:
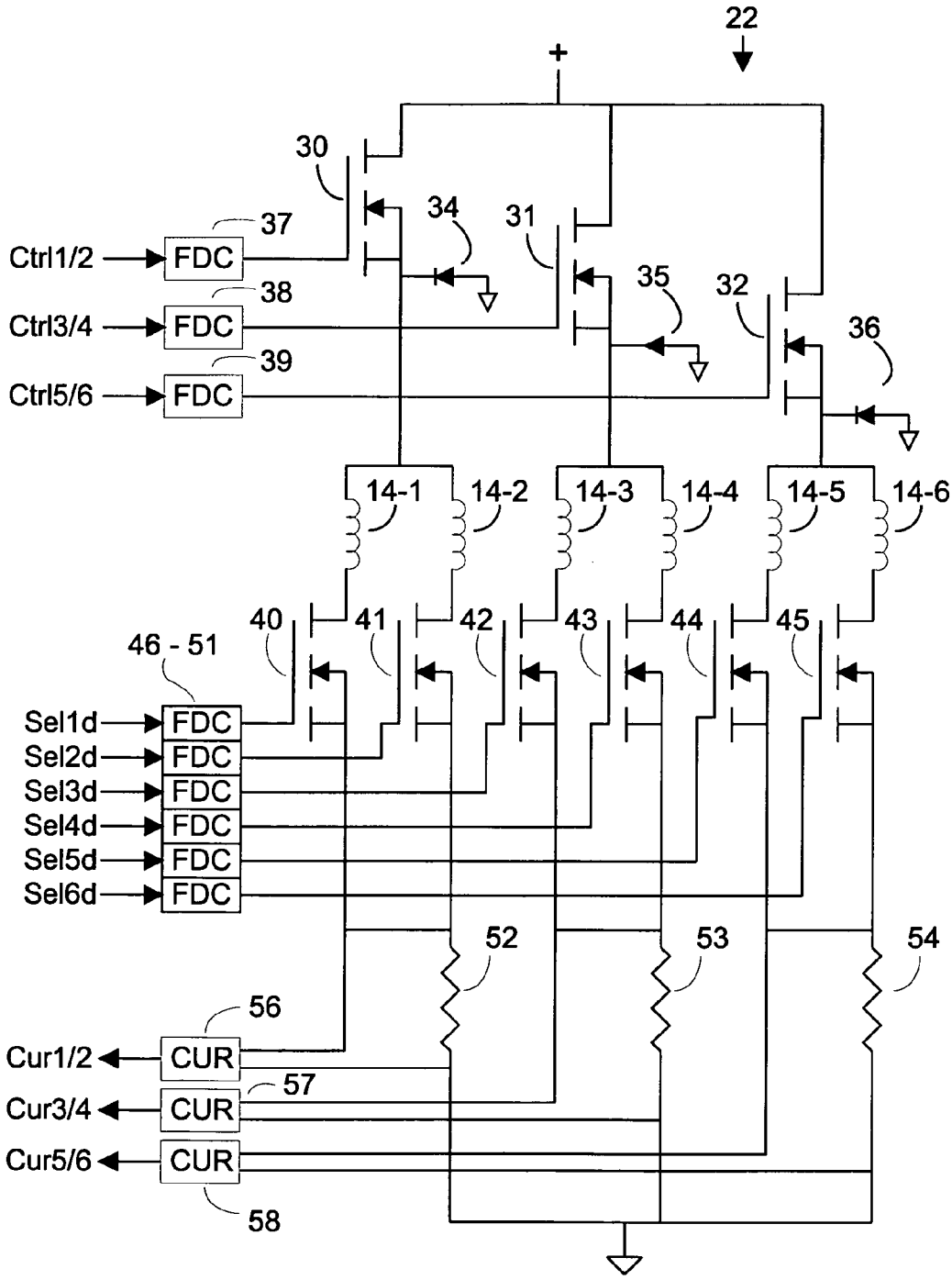
FIG. 3 shows a combined block and circuit diagram of an injector drive circuit arrangement used for circuit level fuel injector control in the engine fuel supply system of FIG. 1.

The drive circuits and injectors of block 22 are shown in FIG. 3 in a standard arrangement. Electrical line connections in this and other Figures of this document are designated as a node of three lines in modern accepted practice; and a node of four lines thus indicates lines that cross in the Figure but are not connected to each other. In addition, the use of the words "upper" and "lower" to identify circuit components in this description is solely to aid the reader in navigating the description of this embodiment. It is not meant to exclude equivalent circuits.

Each of the six injectors 14 is represented by its solenoid coil (14-1 to 14-6), by which it is activated. The solenoid coils are arranged in three banks of two injectors each (14-1 and 14-2, 14-3 and 14-4, 14-5 and 14-6). The upper ends of the solenoid coils in each bank are connected together to the source of an upper FET (respectively 30, 31, 32); and the drains of all these FETs are connected in parallel to a DC power supply, indicated by "+". One of recirculation diodes 34, 35, 36 is connected to the source of each upper FET (respectively 30, 31, 32), and the anodes of these diodes are connected to ground. A separate FET drive circuit "FDC" (respectively 37, 38, 39) is connected to the gate of each upper FET 30, 31, 32, so that each FET drive circuit 37, 38, 39 controls both injector solenoids of a single bank. Each FET drive circuit 37, 38, 39 receives an upper FET control signal (respectively Ctrl1/2, Ctrl3/4, Ctrl5/6) from injector current pulse profile control 20.

The lower end of each individual injector solenoid coil (14-1, 14-2, . . . , 14-6) is connected to the drain of a separate lower FET (respectively 40-45); and the gate of each lower FET 40-45 is connected to its own FET drive circuit FDC (respectively 46-51, in the same order). Each of lower FET drive circuits 46-51 receives a lower FET control signal (respectively, Sel1*d* Sel2*d*, . . . , Sel6*d*) from injector current pulse profile control 20. The sources of each pair of lower FETs (40 and 41, 42 and 43, 44 and 45) are connected together, in the same banks as their associated injector solenoid coils, through a current sensing resistor to ground (FETs 40, 41 through resistor 52, FETs 42, 43 through resistor 53, and FETs 44, 45 through resistor 54). A pair of lines connect the opposite ends of each current sensing resistor 52, 53, 54 to a separate injector current signal measuring circuit labeled "CUR" (respectively 56, 57, 58) that provides an injector current feedback signal (respectively Cur1/2, Cur3/4, Cur5/6) to injector current pulse profile control 20.

In the operation of this standard circuit, any one of the fuel injectors 14 (for example, the injector with solenoid coil 14-1) is selectively activated by both (1) activation of a lower FET (in this example, FET 40) connecting the lower end of the selected solenoid coil to ground through resistor 52 and (2) activation of an upper FET (in this example, FET 30) connecting the upper end of the selected solenoid coil to the positive supply. The upper FET is preferably switched in pulse modulation to vary the current level in the solenoid coil. The current through the selected coil generates a voltage across series resistor 52 from which an injector current signal is derived by the corresponding injector current signal measuring circuit CUR 56 (in this example, signal Cur1/2 from CUR 56).

The common bank connection arrangement is not required for the invention herein but is advantageous in that it reduces the component requirements, with only one set of FETs 40-45 provided uniquely to each injector for separate control thereof while the required number of each of the other drive components is cut in half. In this arrangement, each bank may be controlled independently of the others, but only one injector in each bank may be activated at a time. In addition, some alternative embodiments may replace recirculation current diodes 34, 35, 36 with recirculation FETs that are switched on and off as required in a manner known in the art. Furthermore, in a known variation of the embodiment shown, a second "upper" FET for each bank connected to a higher ("boost") supply voltage may be provided in parallel with each upper FET 30, 31, 32, with its gate connected to a separate FET drive circuit to selectively provide a higher injector drive voltage when desired.

Figure 4:
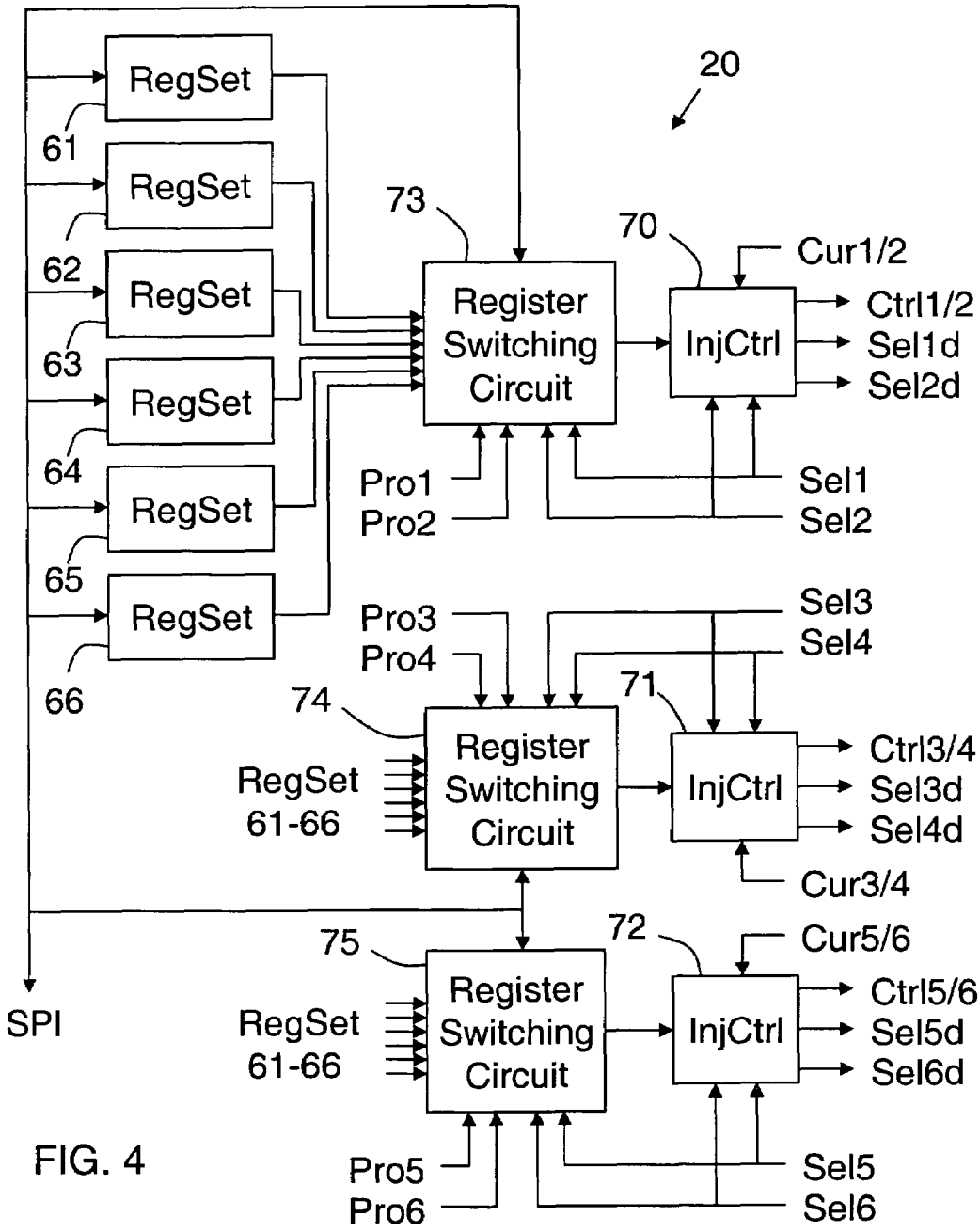
FIG. 4 shows a block diagram of the injector current pulse profile control of FIG. 2.

FIG. 4 shows a block diagram of a portion of injector current pulse profile control 20. This control is preferably an application specific integrated circuit (ASIC) using mostly digital circuitry for maximum speed of operation. Control 20 comprises a plurality of register sets, labeled "RegSet" in the Figure. In this embodiment, six such register sets 61, 62, 63, 64, 65 and 66 are shown. This number conveniently matches the number of injectors; but neither this fact nor the number shown is required for this invention. Each of register sets 61-66 is connected to the communication bus SPI for receiving a set of injector current profile defining parameters sent by engine fuel control 18. Each of the register sets may comprise a single register or a plurality of registers. The single register embodiment may be used if the sets of injector current profile defining parameters are to be loaded once into each register set at the initiation of engine operation, prior to any possibility of conflict between the loading of the parameters into the register and the use of the parameters in the register. The plurality of registers are used to enable buffering of parameter loading during engine operation to avoid such conflicts. Any typical buffering arrangement provides at least an input register connected to receive a set of injector current profile defining parameters from engine fuel control 18 over communication bus SPI and hold it until an output register, connected to the circuitry using the register contents, is free to receive it.

Control 20 further comprises a plurality of injector control circuits, numbering three in this embodiment and labeled "InjCtrl" 70, 71, 72: one for each bank of injectors. Each injector control circuit is provided with a pair of the injector select lines for its bank as inputs: Sel1 and Sel2 for injector control circuit 70, Sel3 and Sel4 for injector control circuit 71, and Sel5 and Sel6 for injector control circuit 72. Each injector control circuit provides output control signals to the upper and lower FET drive circuits of its bank. For injector control circuit 70, these signals are Ctrl1/2 to FDC 37, Sel1*d* to FDC 46 and Sel2*d* to FDC 47. Similarly, for injector control circuit 71, these are Ctrl3/4 to FDC 38, Sel3*d* to FDC 48 and Sel4*d* to FDC 49. Finally, for injector control circuit 72 these are Ctrl5/6 to FDC 39, Sel5*d* to FDC 50 and Sel6*d* to FDC 51.

Figure 6:
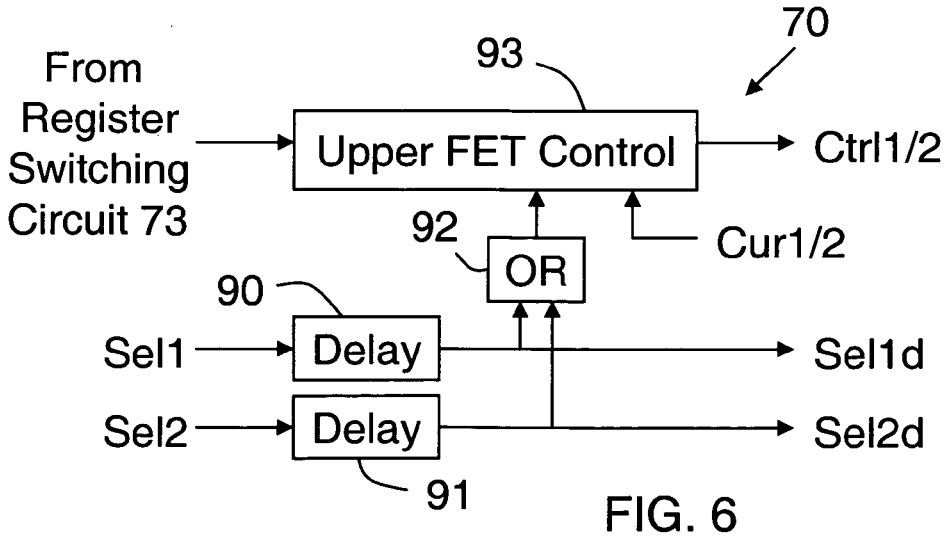
FIG. 6 shows a block diagram of an injector current control for use in the injector current pulse profile control of FIG. 4.

Injector control circuits 70, 71 and 72 are known in the art, with the exception of changes described herein or minor alterations that would be obvious to one of ordinary skill in the art to adapt the circuits to this invention. An example block diagram of injector control circuit 70 is shown in FIG. 6. Referring to FIG. 6, injector control circuit 70 receives signals on lines Sel1 and Sel2 as inputs and applies a small time delay to the signals in signal delay circuits 90 and 91 to create delayed signals Sel1*d* and Sel2*d*. This time delay is only applied upon activation of Sel1 or Sel2; no time delay is applied upon deactivation of Sel1 or Sel2. The resulting delayed signals Sel1*d* and Sel2*d* are combined in logical OR block 92, the output of which is provided to an upper FET control 93 to assist in the generation of output signal Ctrl1/2 applied to FDC 37 to control the gate of upper FET 30.

For the lower FETs, signal Sel1*d* is applied to FDC 46 to control the gate of lower FET 40; and signal Sel2*d* is applied to FDC 47 to control the gate of lower FET 41. Thus, each of lower FETs 40 and 41 is controlled in timing and duration in a manner coordinated with upper FET 30 in the control of injectors 14-1 and 14-2 of the first bank. The time delay upon activation of Sel1 or Sel2 is typically small—for example, 2-3 microseconds—and is used to provide operational time for a register switching circuit yet to be described. The microprocessor in engine fuel control 18 is configured to compensate the injection timing and duration signals on lines Sel1 and Sel2 for the small time delay introduced by delay circuits 90 and 91 in timing the activation and deactivation of injector solenoid coils 14-1 and 14-2 by delayed signals Sel1*d* and Sel2*d*. This may be done by issuing the timing signals for the beginning of injector activation in advance of the determined time by an amount equal to the delay time so that delayed signals Sel1*d* and Sel2*d* represent the actual timing. Similar circuitry in injector control circuits 71 and 72, not shown, provides delayed signals Sel3*d* and Sel4*d* for controlling injection timing and duration in injectors 14-3 and 14-4 of the second bank and delayed signals Sel5*d* and Sel6*d* for controlling injection timing and duration in injectors 14-5 and 14-6 of the third bank in the same manner. In the claims section of this document, the phrase "first injection pulse signal" means an original injection pulse signal—such as Sel1 or Sel2—provided to injector current pulse profile control 20 by engine fuel control 18 via an injector select line; and the phrase "second injection pulse signal" means a signal such as Sel1*d* or Sel2*d* that is produced in delay circuits such as 90 and 91 within injector current pulse profile control 20.

It should be apparent that, if the injectors are not grouped in banks, a separate injector current control will be provided for each injector. One of ordinary skill in the art will realize that each of these injector control circuits will receive signals on a different one (and only one) of the injector select lines (for example, Sel1), will apply a delayed version (Sel1*d*) of those signals to the upper FET control for a single injector solenoid coil (14-1), and will provide the same delayed version (Sel1*d*) of the signals to the lower FET of the same injector, with no need for logical OR block 92.

Upper FET control 93 of injector control circuit 70 (and likewise the upper FET controls, not shown, in each of injector control circuits 71 and 72) is a state machine using known circuitry to control the injector current for pulses in the injectors of its bank in accordance with the timing and duration provided on the injector select lines for the bank and a set of injector current profile defining parameters. The general form of the injector current profile may comprise, for example, a series of consecutive current phases, wherein the current in each phase is initially brought to a predetermined current level and then maintained substantially at this level throughout the remainder of the phase. Each injector control circuit may comprise comparators and logic providing an ON/OFF switching signal for the controlled upper FET to maintain the current during a phase responsive to a current feedback signal and switching thresholds comprising maximum and minimum current levels. The current feedback signals are Cur1/2 from CUR 56 (FIG. 3) to injector control circuit 70 of the first bank, Cur3/4 from CUR 57 to injector control circuit 71 of the second bank, and Cur5/6 from CUR 58 to injector control circuit 72 of the third bank.

Figure 8:
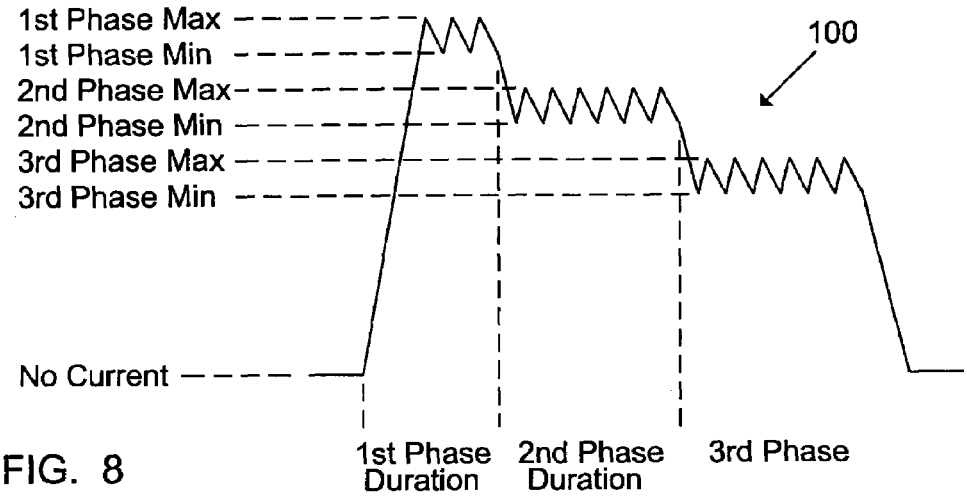
FIG. 8 shows a template of an injector current profile illustrating its shape and defining injector current profile parameters.

An example of a template for an injector current profile is shown in the injector current waveform 100 of FIG. 8. This profile template comprises three current phases; and each phase is characterized by a maximum current parameter and a minimum current parameter. Each phase except the last (the 3rd in this example) is also characterized by a phase duration parameter. No such phase duration parameter is needed for the last phase since the actual fuel pulse is ended by the injector select line signal. Thus, for the example given, the set of injector profile defining parameters comprises at least a 1st Phase Max current, a 1st Phase Min current, a 1st Phase Duration, a 2nd Phase Max current, a 2nd Phase Min current, a 2nd Phase Duration, a 3rd Phase Max current, and a 3rd Phase Min current. Each of these parameters may be stored as an eight bit binary number, giving 256 possible values for each parameter and taking up a total of 64 bits of memory or register space. Each number would be scaled in use by the parameters of the circuitry using it, with the Max and Min current values used as thresholds by comparators also provided with the current signal CUR1/2 to maintain the current acceptably constant by switching upper FET 30 off and on between the Max and Min Current values for a duration determined by the appropriate phase duration parameter or by deactivation of the injector select line signal, as will be described in more detail below. Of course, the actual values of these parameters will be determined for the stored injector current profiles for a particular engine application; and the template allows great flexibility and variety in the stored profiles. Furthermore, any of these injector profile defining parameters may be adjusted when the engine is operating according to other inputs such as battery voltage or fuel pressure.

Figure 7A:
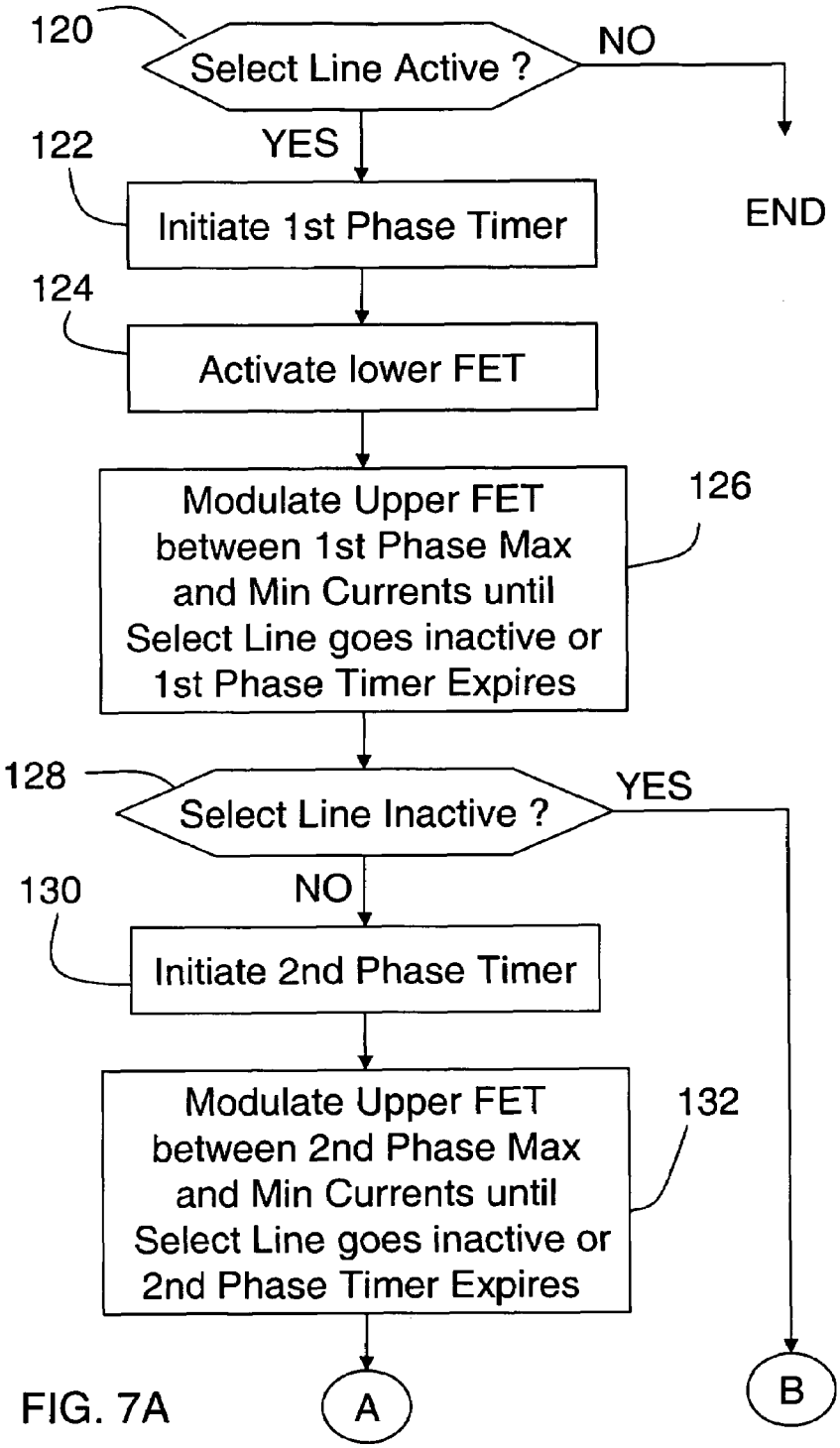
FIGS. 7A and 7B show a state machine flowchart of the operation of each of the injector current controls of FIG. 4.
Figure 7B:
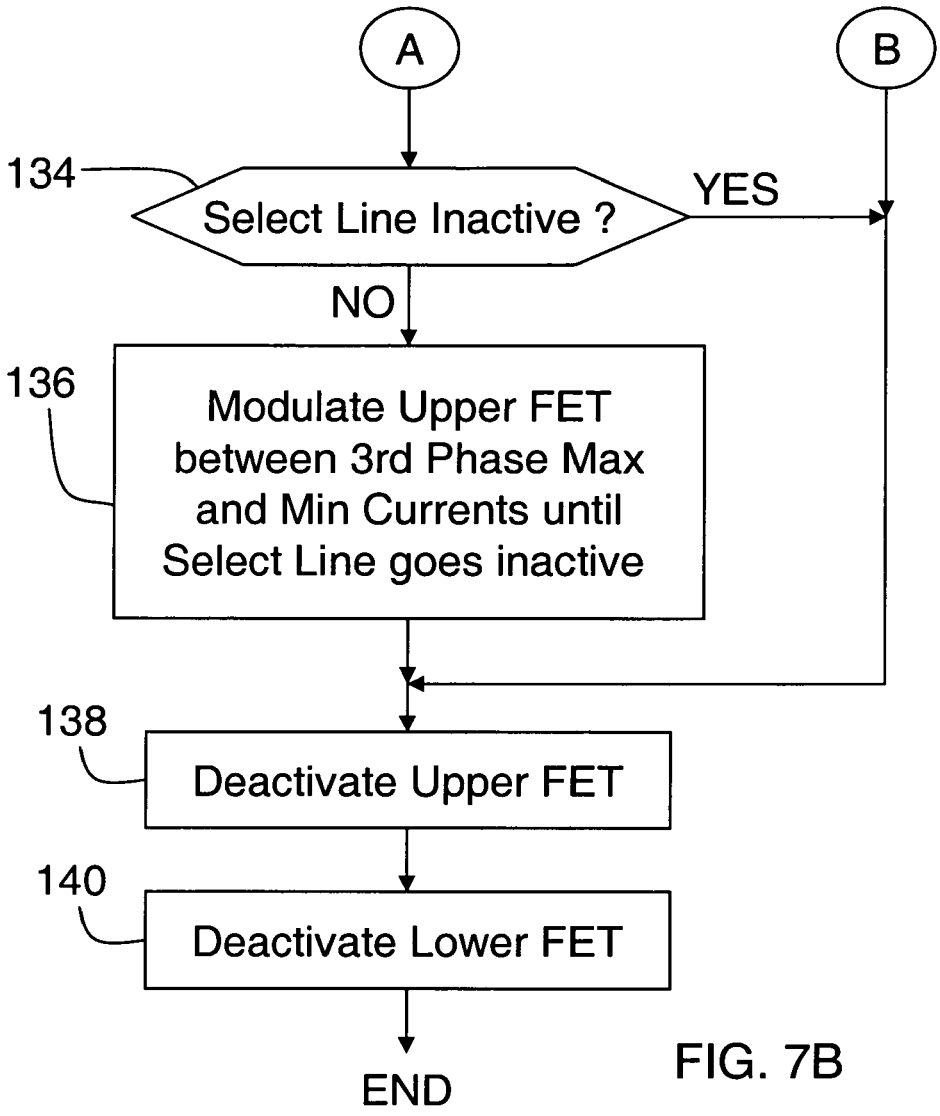

At the first application of electric power to engine fuel supply system 12, prior to engine starting, engine fuel control 18 loads a predetermined one of its stored sets of injector current profile defining parameters in each of register sets 61-66 through communication bus SPI. During operation, each of injector control circuits 70, 71, 72 is connected by switching apparatus yet to be described to selected ones of register sets 61-66 and operates in accordance with the state machine operational chart shown in FIGS. 7A and 7B using the contents of the register set to which it is connected for any given injection pulse to control the current profile throughout the pulse. The operation of injector control circuit 70, for example, begins when one of select lines Sel1 or Sel2 switches to its active level. The delayed signal Sel1*d* or Sel2*d* is detected at decision point 120. With such determination, the circuit initiates a 1st Phase Timer at step 122 and proceeds at step 124 to activate the lower FET 40 or 41 corresponding to the one of delayed signals Sel1*d* or Sel2*d* that is detected. At step 126 the injector current is modulated in closed loop control (responsive to the current signal CUR1/2) between switching values determined by the parameters 1st Phase Max and 1st Phase Min. This is accomplished by switching FET 30 off when a rising CUR1/2 reaches the current value indicated by 1st Phase Max and switching FET 30 on when a falling CUR1/2 reaches a current value indicated by 1st Phase Min. This modulation is continued until terminated by either the select line going inactive (as indicated by Sel1*d* or Sel2*d*) or the 1st Phase Timer expiring, which expiration is determined by the parameter 1st Phase Duration. If the termination is due to a determination that the select line has gone inactive, the fuel pulse as determined by engine fuel control 18 is finished and the injector control circuit ends activation of the upper FET 30 at step 138 and the lower FET 40 or 41 at step 140.

Alternatively, if the termination is due to expiration of the 1st Phase Timer, the circuit initiates a 2nd Phase Timer at step 130 and proceeds at step 132 to modulate the upper FET 30 of the bank in the manner described above with respect to the 1st phase, but between the 2nd Phase Max and Min values. This state is continued until terminated by either the select line going inactive or the 2nd Phase Timer expiring, which expiration is determined by the parameter 2nd Phase Duration. If the termination is due to a determination that the select line has gone inactive, the fuel pulse as determined by engine fuel control 18 is finished and the injector control circuit ends activation of the upper FET 30 at step 138 and the lower FET 40 or 41 at step 140.

Alternatively, if the termination is due to expiration of the 2nd Phase Timer, the circuit proceeds at step 136 to modulate upper FET 30 of the bank in the manner described above with respect to the 1st phase, but between the 3rd Phase Max and Min values. This state is continued until terminated when delayed signal Sel1*d* or Sel2*d* indicates that the corresponding select line is no longer active and the upper and lower FETs are deactivated at steps 138 and 140, respectively. It should be noted that, when the injector is deactivated at the end of the injection pulse, it may be desirable to control the lower FET in such a manner as to clamp the flyback voltage of the inactivated injector coil 14-1 or 14-2.

In the apparatus and method of this invention, each of the injector control circuits of this engine fuel supply system 12 accesses injector current profile defining parameters from the register sets through a switching apparatus potentially capable of connecting each of the injector control circuits to any one of the register sets at a time. In addition, the apparatus of this embodiment can provide this connection in several alternative ways, each of which has its own advantages and costs.

Figure 5:
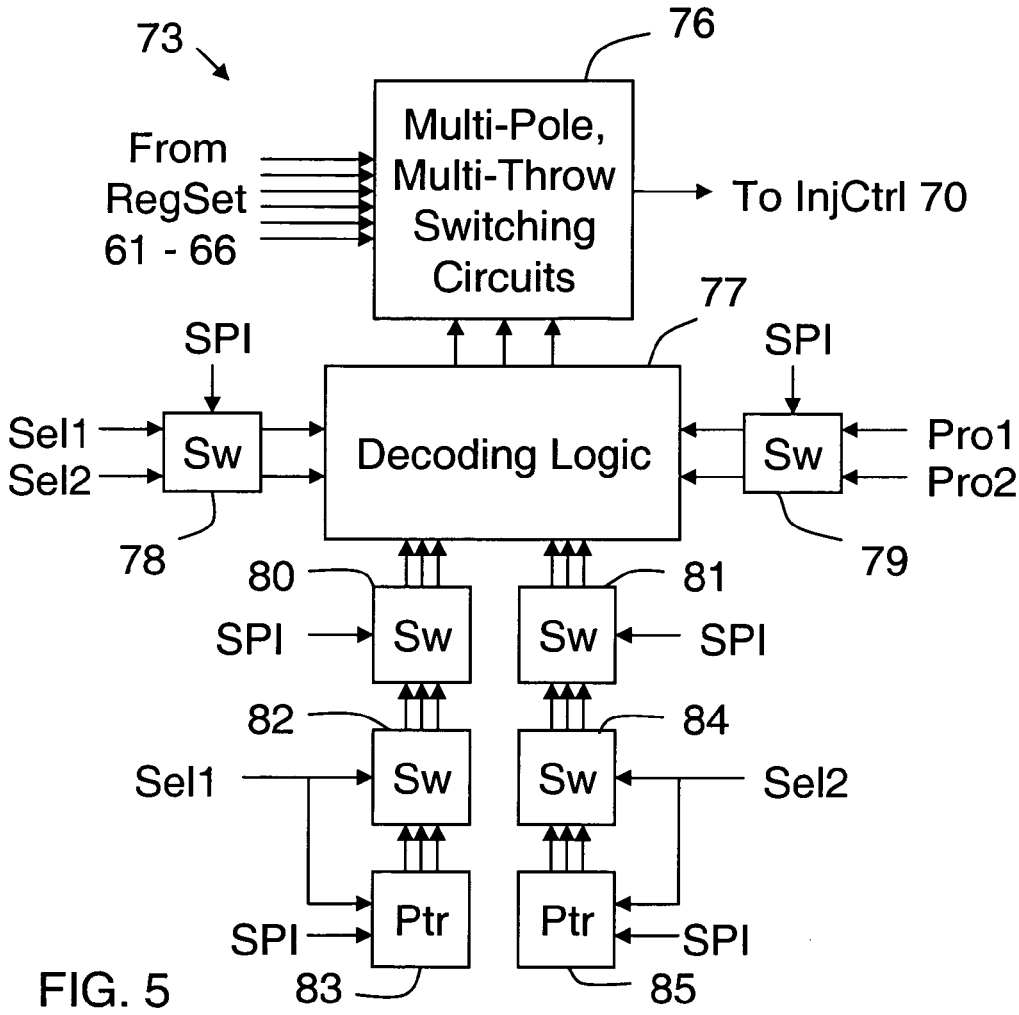
FIG. 5 shows a block diagram of a register switching circuit for use in the injector current pulse profile control of FIG. 4.

Referring to FIG. 5, switching apparatus in the form of a register switching circuit 73 is capable of connecting injector control circuit 70 of the first bank alternatively to any one of register sets 61-66. When such connection is made, injector control circuit 70 has access to the set of injector current profile defining parameters, as well as any other useful data, that is stored in the register. This may be accomplished by connecting each portion of injector control circuit 70 requiring the value of a data bit in a register set to the output pin of that register set providing that data bit through a multi-pole, multi-throw switching circuit 76, wherein the electronic switches required to accomplish this together are capable of providing simultaneous changes of the switch connections to produce six switch configurations: one for the connection of injector control circuit 70 to each of selectable register sets 61-66. The configuration of multi-pole, multi-throw switching circuit 76 is controlled by decoding logic 77, which has inputs receiving a plurality of signals to be described.

The switching configuration of register switching circuit 73 is determined by a plurality of auxiliary switches 78-81, each of which is controlled by engine fuel control 18 by a mode selection signal via the communication bus SPI to allow the application of different sets of register selecting signals to the decoding logic 77. Fuel control 18 is capable of placing the group of auxiliary switches 78-81 in any one of at least three different auxiliary switch configurations, each of which allows a different set of register selecting signals to control multi-pole, multi-throw switching circuit 76 and thus produce a different mode of operation in the connection of injector control circuit 70 to the register sets 61-66. These three auxiliary switch configurations are produced when, selectively (1) only auxiliary switch 78 is activated, (2) only auxiliary switch 79 is activated, and (3) only auxiliary switches 80 and 81 are activated. In an embodiment wherein the injectors are not banked, only one of auxiliary switches 80 and 81 would be required. In an alternative embodiment, the mode selection signal could be provided to the auxiliary switches by one or more binary digital communication lines from the microprocessor of engine fuel control 18, if the required microprocessor output pins are available.

Auxiliary switch 78 controls the connection of the injector select lines Sel1 and Sel2 to decoding logic 77 so that they are connected to the latter—and thus also become register selecting signals—only when auxiliary switch 78 is activated to its connecting condition. Thus, the first auxiliary switch configuration is produced by a signal on communication bus SPI to auxiliary switch 78 to connect the injector select lines Sel1 and Sel2 to decoding logic 77, while signals on communication bus SPI cause auxiliary switches 79-81 to be open. Decoding logic 77 thus decodes an active line Sel1, by itself, to produce the switch configuration of multi-pole, multi-throw switching circuit 76 in which injector control 70 is connected to register set 61. Likewise, decoding logic 77 decodes an active line Sel2, by itself, to produce the switch configuration of multi-pole, multi-throw switching circuit 76 in which injector control 70 is connected to register set 62. When either of lines Sel1 and Sel2 is not active, it is decoded in decoding logic 77 to produce no switching. But an active output in either signal will be decoded to cause a switch to a predetermined one of register sets 61, 62. Thus, in this auxiliary switch configuration and mode of operation, the injector select lines Sel1 and Sel2 are also the register select lines that determine the register set that is connected to injector control circuit 70, with register set 61, for example, being so connected while select line Sel1 is active and, alternatively, register set 62, for example, being so connected while select line Sel2 is active. Since select lines Sel1 and Sel2 control injectors 14-1 and 14-2 in the same bank, engine fuel control 18 is programmed to ensure that they are never active at the same time; and decoding logic 77 is thus protected from receiving simultaneous contradictory signals. In addition, the short time delay provided to the signal on injector select line Sel1 within injector control circuit 70 to produce the corresponding injector activating signal Sel1*d*, allows the proper configuration of multi-pole, multi-throw switching circuit 76 by the signal on line Sel1 acting as a register select line to be accomplished prior to the activation of upper FET 30 and lower FET 40 by signal Sel1*d*, so that injector control circuit 70 has access to the set of injector current profile defining parameters in register set 61 in a timely manner for the activation of injector solenoid coil 14-1. The same is true for signals Sel2 and Sel2*d*, register set 62 and injector solenoid coil 14-2.

In this auxiliary switch configuration, injector 14-1 will always be controlled according to the set of injector current profile defining parameters stored in register set 61 while injector 14-2 will always be controlled according to the set of injector current profile defining parameters stored in register set 62. This is the auxiliary switch configuration that would be used to continue the prior art practice of consistently using a single predefined set of injector current profile defining parameters with each injector. Such parameter sets can be the same for multiple injectors or tuned to each injector for optimal injector performance. The set of injector current profile defining parameters for each injector would be loaded in the appropriate register set at the beginning of engine operation and would remain unchanged as long as this auxiliary switch configuration is desired. If an injector is replaced, a new set of injector current profile defining parameters could be programmed into engine fuel control 18 to replace the set used by the injector that is removed. Many fuel injectors are delivered with machine readable data (such as barcodes) on the injector or packaging including such information.

The use of this first switch configuration, however, does not preclude the changing of injector current profile characteristics during engine operation. Although the register sets are tied to predetermined injectors, the set of injector current profile defining parameters in either one of register set 61 and register set 62 can be replaced by engine fuel control 18 with others stored in its memory or dynamically calculated whenever there is sufficient time to reliably perform the data transfer over communication bus SPI. With currently available and affordable technology, however, this auxiliary switch configuration is not likely to be reliable for changing injector current profiles between multiple consecutive fuel pulses during a single combustion event.

The second switch configuration of the auxiliary switches 78-81 is produced when auxiliary switch 79 is activated by the communication bus SPI while the other auxiliary switches 78, 80 and 81 are deactivated. With auxiliary switch 79 activated, register select lines Pro1 and Pro2 are connected to decoding logic 77. These register select lines are binary signal lines from engine fuel control 18 that together provide a binary encoded signal identifying any one of a selected plurality of register sets 61-66. With auxiliary switch 79 activated, these lines deliver the binary encoded signal to decoding logic 77 within register switching circuit 73 to configure multi-pole, multi-throw switching circuit 76 for connecting injector control circuit 70 to the register set indicated by the binary code.

Figure 9:
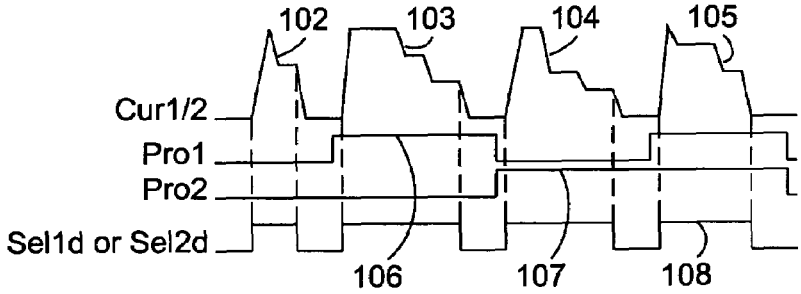
FIGS. 9 and 10 show timing diagrams each illustrating a different mode of operation of a direct fuel injection control according to this invention.

The operation of the apparatus in this auxiliary switch configuration is described with respect to the timing and waveform diagrams of FIG. 9. A current waveform at the top of FIG. 9 shows the current in a selected one of injectors 14-1 and 14-2 for four consecutive injection events, with the injector current profiles produced by this apparatus in the four events indicated as injector current waveforms 102-105. Each of these waveforms has a profile that is different in shape from the others because each is produced with a set of injector current profile defining parameters in a different one in a subset of four of register sets 61-66. The timing and duration of each of the events is determined by the lowest waveform 108, which shows the state of whichever one of Sel1*d* or Sel2*d* is producing the events, with a beginning of each event initiated at the leading edge of a positive waveform pulse and the end of each event initiated at the trailing edge of the pulse. The middle waveforms 106 and 107 show the states of register select lines Pro1 and Pro2, respectively, as produced by engine fuel control 18. The four current injection event profiles correspond to the following binary codes of the register select lines (Pro1, Pro2): waveform 102 (0,0), waveform 103 (1,0), waveform 104 (0,1), waveform 105 (1,1).

Engine fuel control 18 changes the states of the register select lines Pro1 and Pro2 in time for the injector select line (Sel1 or Sel2) to cause upper the upper (30) and lower (40 or 41) FETs selected thereby to activate the selected injector using the chosen injector profile, as indicated by the change in state of the Pro1 and Pro2 waveforms 106 and 107 prior to the leading edge of the injector select line waveform 108. Thus, in this auxiliary switch configuration and mode of operation, separate register select lines carry the signals Pro1 and Pro2 to control the register selection. This permits any of the register sets 61-66 to potentially be selected for connection to any of the injector control circuits 70, 71, 72, although this potential is limited by the number of bits in the code. For the two bit binary code that is possible on register select lines carrying signals Pro1 and Pro2, the selection for each injector control circuit is limited to four of the register sets. This selection for any given injector control circuit is independent of that for any other, assuming that independent register select lines are used in the register switching circuit (73, 74, 75) for each injector control circuit (70, 71, 72). In addition, since the communication speed of the register select lines Pro1 and Pro2 is much faster than that of the communication bus SPI, this auxiliary switch configuration reliably enables changes of injection current profile defining parameters by multi-pole, multi-throw switching circuit 76 between multiple consecutive activations of the same injector in a single combustion event, as illustrated in FIG. 9.

It should be noted that the capability of this auxiliary switch configuration for fast consecutive changes of injector current profiles in consecutive injector activations comes with a price: the need to use an additional output pin of the microprocessor in engine fuel control 18 for each bit of the binary code carried by the register select lines. With the two register select lines Pro1 and Pro2 of this embodiment, a maximum number of four of the six register sets are available to injector control circuit 70 in this auxiliary switch configuration. Access to all six register sets 61-66 could be accomplished with a third register select line (which would actually handle up to eight register sets); but this would be at the cost of yet another output pin of the microprocessor in engine fuel control 18 when this auxiliary switch configuration is selected. However, it should also be noted that, when this auxiliary switch configuration is not used, these register select lines Pro1, Pro2, etc. may be free for other uses.

The third auxiliary switch configuration of this embodiment is achieved when engine fuel control 18 activates auxiliary switches 80 and 81 and deactivates auxiliary switches 78 and 79. This configuration uses pointer circuits within register switching circuit 73 to determine the selected register set, with the output of the pointer circuit being a pointer comprising the register select signal provided to decoding logic 77.

The signal on injector select line Sel1 is connected to a pointer circuit (Ptr) 83, the output of which is connected through a switch 82 and auxiliary switch 80 in series to decoding logic 77. Likewise, the signal on injector select line Sel2 is connected to a pointer circuit (Ptr) 85, the output of which is connected through a switch 84 and auxiliary switch 81 in series to decoding logic 77. Switch 82 is activated by signals on injector select line Sel1, while switch 84 is activated by signals on injector select line Sel2. With auxiliary switches 80 and 81 activated by engine fuel control 18, the connection of either of pointer circuits 83 and 85 depends on the status of the register select lines Sel1 and Sel2.

Each of pointer circuits 83 and 85 is a circuit storing digitally encoded pointers to register sets and including a pointer selector to produce these pointers in a predetermined order responsive to activating signals on the injector select line connected to it. The pointer selector is reset to an initial value by a reset signal on the same injector select line. This configuration is specifically directed to a mode of operation in which (1) each injector is activated in multiple injections per combustion event, and (2) a pointer circuit is used to determine the selection of register sets for consecutive injection pulses of the combustion event based on a plurality of stored pointers. The combustion event begins with a first injection event using a predetermined initial pointer and continues with subsequent injection events using additional stored pointers in a predetermined order until (1) no new injector activations are signalled for the combustion event or (2) the last stored pointer is reached. In the first case, the combustion event is finished; in the second case, the last stored pointer is repeatedly used for any further injection events until the end of the combustion event.

Since the injector select lines Sel1 and Sel2 will never be activated by engine fuel control 18 at the same time, only one of pointer circuits 83 and 85 can be connected to decoding logic 77 at any given time. Thus, the operation of this configuration may be described with respect to only one of the pointer circuits, with that operation being identical for the other. It will be described for pointer circuit 83, with the aid of the block diagram of FIG. 11 and the waveforms shown in FIG. 10.

Figure 11:
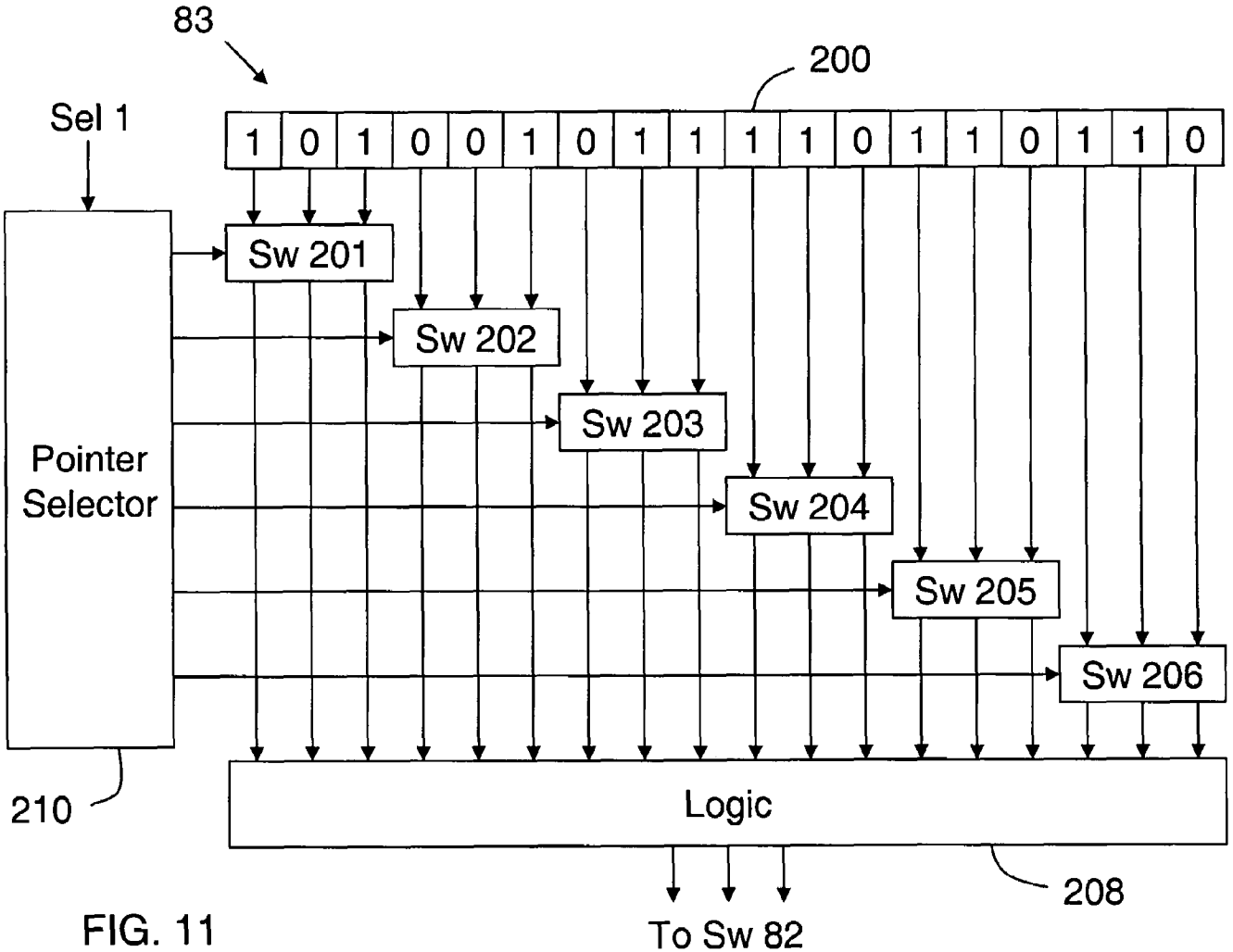
FIG. 11 shows a block diagram of a pointer circuit for use in the register switching circuit of FIG. 5.

Referring to FIG. 11, pointer circuit 83 includes a pointer register 200, which is shown having 18 bit locations. These 18 bit locations may be loaded with six groups of 3 digital bits so that each group of 3 digital bits identifies any one of register sets 61-66. In this embodiment, pointer register 200 is connected to engine fuel control 18 by the SPI communication bus for loading of pointers at appropriate times prior to, or during, engine operation.

An output line is provided from each bit location in register 200, and these output lines are connected in parallel, by the groups of their corresponding bit locations, through six separate pointer internal switches 201, 202, . . . , 206, to a logic circuit 208. Each of switches 201-206 is controlled by a separate output line of a pointer selector 210 to simultaneously connect or disconnect all three of the register 200 output lines in its control with logic circuit 208. Pointer selector 210 is capable of activating only one of its output lines at any given time. It is configured to be reset by a reset signal on injector select line Sel1 to activate a first predetermined output line (for example, the output line controlling switch 201) and to then incrementally and alternatively activate its other output lines in stepwise order (for example, downward in FIG. 11) responsive to consecutive deactivation signals on injector select line Sel1. Logic circuit 208 is configured to pass through to its output, and thus to switch 82, the digital code on the three output lines connected to it by the activated one of switches 201-206. The other pointer circuits of this apparatus, such as pointer circuit 85 of FIG. 5 and the others, not shown, of register switching circuits 74 and 75, are similar in construction and operation.

Figure 10:
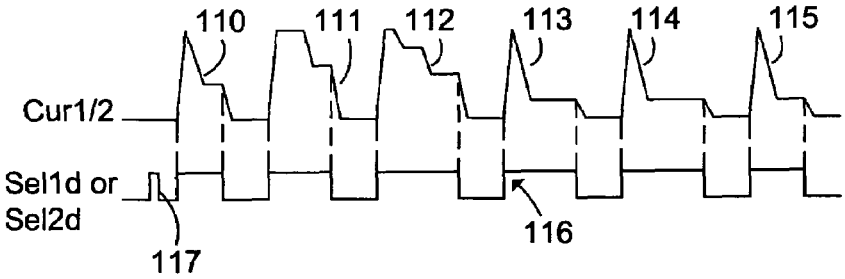

Referring to FIG. 10, injector current waveforms 110-115 illustrate one example of a set of consecutive fuel injection pulses that are produced by injector current control 70 in consecutive activations of a single injector (for example, solenoid coil 14-1 using pointer circuit 83). Engine fuel control 18 outputs an initial, very short (for example, about 1 microsecond in duration) reset pulse 117 on injector select line Sel1. This pulse resets pointer circuit 83 to generate an output specifying an initial predetermined register set such as register set 65. The reset pulse, which is designed to be shorter in duration than the 2-3 microsecond delay produced by delay circuit 90, is suppressed in the delayed injector select signal Sel1*d*; and it thus does not initiate injector activation. In addition, switch 82 does not respond to the reset pulse. When the next injection activating pulse occurs on line Sel1, switch 82 is activated to its closed state, and injector control circuit 70 is connected to the register set identified by the first three bits "101" in pointer register 200 provided through switch 201 of pointer circuit 83 (for example, register set 65). It thus produces an injector activation from delayed signal Sel1*d* using the set of injector current profile defining parameters stored in register set 65, which results in the injector current waveform 110 of FIG. 10.

In response to line Sel1 going inactive (the trailing edge of an activating pulse), pointer circuit 83 changes its output to point to the register set identified by the next three bits "001" of pointer register 200 passed through by switch 202, for example register set 61. For the next injection initiating pulse on injector select line Sel1, injector control is connected to register set 61 and uses the set of injector current profile defining parameters stored therein to produce the injector current waveform 111. This cycle repeats for each additional fuel injection pulse in the combustion event through register sets defined by the data in the remaining groups of bit positions in pointer register 200 as switched through by pointer switches 203-206 in order to produce injector current waveforms 112, 113, 114 and 115 in turn, after which pointer selector 210 no longer changes its output. When pointer selector 210 reaches its last position, in which it activates switch 206, it cannot advance further; and any needed additional pulses are produced using the parameters stored in the register set identified by the last group of data bits in pointer register 200 passed through by switch 206. Of course, the actual combustion event does not have to result in all of these individual injection events: it only lasts as long as injection pulses appear on injector select line Sel1. And, since no signals have appeared on injector select line Sel2, unactivated switch 84 shields decoding logic 77 from the contents of pointer circuit 85. The number of three-bit groups provided in pointer register 200 within pointer circuit 83 has been conveniently chosen in this embodiment to equal the number of register sets containing injection current profile defining parameters. But a different number of bit locations could be provided. In addition, the presence of identical pointers "110" in the bit positions switched by switches 204-206 illustrate that the pointers stored in pointer register 200 don't all have to be different. The fact that each group of 3 bit positions in pointer register 200 may be filled with a data pointer to any of the register sets provides great flexibility of injector current profiles, even in fast repeating consecutive injection pulses in a single combustion event.

Engine fuel control 18 determines which of the switching configurations described above are in use; and it sends signals over serial communication bus SPI to auxiliary switches 78, 79, 80, 81 of register switching circuit 73 and the corresponding auxiliary switches of additional switching circuits 74 and 75 to accomplish this. As previously described, engine fuel control 18 sets up the first switching configuration of the state machine by activating auxiliary switch 78 while deactivating auxiliary switches 79, 80 and 81. Engine fuel control 18 activates the second switching configuration by activating auxiliary switch 79 while deactivating auxiliary switches 78, 80 and 81; and it sets up the third switching configuration by activating auxiliary switches 80 and 81 while deactivating auxiliary switches 78 and 79. Engine fuel control 18 is configured by programming its microprocessor to set up one of the switching configurations at system start-up, and it may retain that switching configuration for the entire period of engine operation. Alternatively, it may be configured to change the switching configuration under different operating conditions or for any other reason. Thus, a supplier of engine fuel supply system 12 or its control may deliver a highly adaptable product that can be configured by the customer to the latter's requirements by programming engine fuel control 18. But it is also contemplated that a designer of an engine fuel supply system or its controller could incorporate and use fewer of the disclosed switching configurations (and switches required for them) or other switching configurations not shown.

The invention claimed is:

1. A fuel injection control for an internal combustion engine having a plurality of combustion chambers with at least one electric solenoid activated fuel injector for direct injection of fuel into each of the combustion chambers in one or more fuel injection pulses for each combustion event, the fuel injection control comprising:

a first controller comprising a microprocessor configured to generate injection pulse signals on injector select lines, each of the injector select lines identifying a predetermined one of the fuel injectors and each of the injection pulse signals defining the timing and duration of a fuel injection pulse, the first controller further comprising a memory adapted to store a plurality of sets of injector current profile defining parameters for fuel injection pulses;

a serial communication bus;

a second controller connected to the microprocessor of the first controller via the injector select lines and the communication bus, the second controller comprising a plurality of injector control circuits for activating individual fuel injectors in fuel injection pulses as indicated by the injector select lines and at the times and for the durations indicated by the injection pulse signals thereon, the second controller further having a plurality of register sets connected to the communication bus and adapted to receive thereby sets of injector current profile defining parameters communicated to them by the microprocessor of the first controller; and the second controller further comprising switching apparatus for selectively connecting each of the injector control circuits to alternative ones of the plurality of register sets responsive to register select signals, wherein the electric current in each fuel injection pulse of each of the fuel injectors is controlled by one of the injector control circuits in accordance with the set of injector current profile defining parameters held by the one of the register sets to which it is connected by the switching apparatus.

2. The fuel injection control of claim 1 further comprising a plurality of register select lines connecting the microprocessor of the first controller to the switching apparatus of the second controller, the switching apparatus being responsive to register select signals on the register select lines to determine the one of the register sets to which each of the injector control circuits is connected for each fuel injection pulse.

3. The fuel injection control of claim 1 wherein the switching apparatus of the second controller comprises a pointer register for each fuel injector, each of the pointer registers being configured to store the register select signals as pointers to specific register sets and to provide the pointers in a predetermined order responsive to successive injection pulse signals on the injector select line for the corresponding fuel injector during a single combustion event.

4. The fuel injection control of claim 3 wherein at least one of the pointer registers is configured to store and provide pointers to at least two different register sets.

5. The fuel injection control of claim 3 wherein each of the pointer registers is configured to determine, in response to a unique reset signal on the injector select line for its corresponding fuel injector, the first of the pointers to be provided in a combustion event in the predetermined order.

6. The fuel injection control of claim 1 further comprising:

a plurality of register select lines connecting the microprocessor of the first controller to the switching apparatus of the second controller, the switching apparatus having a first switching configuration in which it is responsive to the register select signals generated by the microprocessor of the first controller on the register select lines to determine the one of the register sets to which each of the injector control circuits is connected for each fuel injection pulse;

a plurality of pointer registers in the switching apparatus of the second controller with one of the pointer registers corresponding to each of the fuel injectors, each of the pointer registers being configured to store the register select signals as pointers to specific register sets and to provide the pointers in a predetermined order responsive to successive injection pulse signals on the injector select line for the corresponding fuel injector during a combustion event, the switching apparatus having a second switching configuration in which it is responsive to the pointers provided by the pointer registers to determine the one of the register sets to which each of the injector control circuits is connected for each fuel injection pulse; and a plurality of auxiliary switches in the switching apparatus responsive to a mode selection signal from the microprocessor of the first controller to select a switching configuration of the switching apparatus from a plurality of such switching configurations including the first switching configuration and the second switching configuration.

7. The fuel injection control of claim 6 wherein the mode selection signal is communicated from the first controller to the second controller via the serial communication bus.

8. The fuel injection control of claim 6 wherein at least one of the pointer registers is configured to store and provide pointers to at least two different register sets.

9. The fuel injection control of claim 6 wherein each of the pointer registers is configured to determine, in response to a unique reset signal on the injector select line for its corresponding fuel injector, the first of the pointers to be provided in a combustion event in the predetermined order.

10. The fuel injection control of claim 6 wherein:

the injector select lines are also connected to the switching apparatus, the switching apparatus has a third switching configuration in which each fuel injection pulse on an injector select line is also a register select signal selecting a predetermined one of the register sets, and the third switching configuration is one of the plurality of switching configurations of the switching apparatus selectable by the auxiliary switches in response to the mode selection signal.

11. A method of providing multiple successive fuel injection pulses by a single fuel injector directly into a combustion chamber of an internal combustion engine during a single combustion event, the method comprising:

providing one or more sets of injector current profile defining parameters in the memory of a first controller;

communicating sets of injector current profile defining parameters from the first controller to a plurality of register sets in a second controller via a serial communication bus such that each one of the plurality of register sets contains a selected one of the sets of injection current profile defining parameters;

generating first injection pulse signals in the first controller, each of the first injection pulse signals signaling a timing and duration of a fuel injection pulse;

providing the first injection pulse signals to the second controller on an injector select line;

generating register select signals;

for each of the first injection pulse signals communicated to the second controller, using switching apparatus in the second controller to connect an injector control circuit in the second controller to one of the register sets of the second controller responsive to one of the register select signals; and in the second controller, generating second injection pulse signals responsive to the first injection pulse signals and activating the fuel injector responsive to the second injection pulses while controlling current in the fuel injector according to the set of injector current profile defining parameters in the one of the register sets to which the injector control circuit is connected.

12. The method of claim 11 wherein the step of generating second injection pulse signals further comprises delaying an initial timing of each of the second injection pulse signals from an initial timing of its corresponding first injection pulse signal by a delay time sufficient to permit the switching apparatus in the second controller to connect the injector control circuit to one of the register sets responsive to one of the register select signals prior to the initiation of a fuel injection pulse using the set of injection current profile defining parameters stored in the one of the register sets.

13. The method of claim 11 wherein the step of generating register select signals further comprises providing the register select signals from the first controller on one or more register select lines separate from the injector select line.

14. The method of claim 13 wherein the step of generating register select signals further comprises providing a selected one of two voltages on each of the one or more register select lines to form a binary code across the one or more register select lines.

15. The method of claim 11 wherein the step of generating register select signals further comprises the steps of:

storing the register select signals in the second controller as pointers to specific register sets; and providing the stored pointers in a predetermined order to determine the register set for each consecutive injection pulse, beginning with a predetermined initial pointer.

16. The method of claim 15 wherein:

the step of storing the register select signals further comprises storing the pointers in a pointer register; and the step of providing the stored pointers in a predetermined order further comprises incrementing a pointer selector responsive to successive fuel injection pulses to select the pointers in the pointer register in a predetermined order of storage therein.

17. The method of claim 11 further comprising the steps of:

providing one or more register select lines connecting the microprocessor of the first controller to the switching apparatus of the second controller, the switching apparatus having a first switching configuration in which it is responsive to the register select signals generated by the microprocessor of the first controller on the register select lines to determine the one of the register sets to which the injector control circuit is connected for each fuel injection pulse;

providing a pointer register in the switching apparatus of the second controller, the pointer register being configured to store the register select signals as pointers to specific register sets and to provide the pointers in a predetermined order responsive to successive first injection pulse signals on the injector select line, the switching apparatus having a second switching configuration in which it is responsive to the register select signals provided by the pointer registers to determine the one of the register sets to which the injector control circuit is connected for each fuel injection pulse; and providing a plurality of auxiliary switches in the switching apparatus responsive to a mode selection signal from the microprocessor of the first controller to select a switching configuration of the switching apparatus, wherein the choice of switching configuration of the switching apparatus includes at least the first switching configuration and the second switching configuration.

18. The method of claim 17 wherein the mode selection signal is communicated from the first controller to the second controller via the serial communication bus.

19. The method of claim 17 wherein the mode selection signal is communicated from the first controller to the second controller during engine operation.

20. The method of claim 17 wherein:

the injector select lines are also connected to the switching apparatus, the switching apparatus has a third switching configuration in which each fuel injection pulse on an injector select line is also a register select signal selecting a predetermined one of the register sets, and the third switching configuration is one of the plurality of switching configurations of the switching apparatus selectable by the auxiliary switches in response to the mode selection signal.

21. The method of claim 12 wherein the step of generating register select signals further comprises the steps of:

storing the register select signals in a pointer register of the second controller as pointers to specific register sets;

responsive to a reset signal comprising a reset pulse on the injector select line having a pulse duration less than the delay time between corresponding first and second injector pulse signals, initializing the pointer register for provision of a predetermined initial pointer; and providing the stored pointers in a predetermined order from the pointer register to determine the register set for each consecutive injection pulse, beginning with the predetermined initial pointer.

* * * * *